US009193430B2

(12) United States Patent
Hosoya et al.

(10) Patent No.: US 9,193,430 B2
(45) Date of Patent: Nov. 24, 2015

(54) TILT-ANGLE ADJUSTING APPARATUS AND SHIP PROPULSION MACHINE

(71) Applicant: SHOWA CORPORATION, Gyoda-shi (JP)

(72) Inventors: Narimasa Hosoya, Haga-gun (JP); Hayato Tsutsui, Haga-gun (JP); Shinya Horie, Haga-gun (JP)

(73) Assignee: SHOWA CORPORATION, Gyoda-Shi (JP)

( * ) Notice: Subject to any disclaimer, the term of this patent is extended or adjusted under 35 U.S.C. 154(b) by 74 days.

(21) Appl. No.: 14/034,804

(22) Filed: Sep. 24, 2013

(65) Prior Publication Data

US 2014/0288735 A1 Sep. 25, 2014

(30) Foreign Application Priority Data

Mar. 19, 2013 (JP) ..... 2013-057392

(51) Int. Cl.
*B63H 21/21* (2006.01)
*B63H 20/10* (2006.01)

(52) U.S. Cl.
CPC ..... *B63H 20/10* (2013.01)

(58) Field of Classification Search
CPC ..... B63H 20/08; B63H 20/10; B63H 20/14; B63H 25/02
USPC ..... 440/1, 53, 61 T, 84; 701/21
See application file for complete search history.

(56) References Cited

U.S. PATENT DOCUMENTS 5,118,315 A * 6/1992 Funami et al. ..... 440/1
5,169,348 A * 12/1992 Ogiwara et al. ..... 440/1
2010/0267296 A1 * 10/2010 Kuriyagawa et al. ..... 440/53

FOREIGN PATENT DOCUMENTS

JP 07-032385 Y2 7/1995

* cited by examiner

*Primary Examiner* — John Q Nguyen
*Assistant Examiner* — Anshul Sood
(74) *Attorney, Agent, or Firm* — Leason Ellis LLP

(57) ABSTRACT

To provide a technique capable of adjusting a tilt angle of a ship propulsion machine body with respect to a hull to a tilt angle suitable for a travelling state easily and with high accuracy. A motor adjusting a tilt angle of a ship propulsion machine body with respect to a hull and a control device controlling drive of the motor so as to change the tilt angle in accordance with an output from a hull angle sensor detecting a hull angle as an angle of the hull with respect to the water surface are included.

3 Claims, 9 Drawing Sheets

TILT-ANGLE ADJUSTING APPARATUS AND SHIP PROPULSION MACHINE

CROSS-REFERENCE TO RELATED APPLICATIONS

This application is based on and claims priority under 35 U.S.C. 119 from Japanese Patent Application No. 2013-057392 filed on Mar. 19, 2013, the entire content of which is incorporated herein by reference.

BACKGROUND OF THE INVENTION

1. Field of the Invention

The present invention relates to a tilt-angle adjusting apparatus and a ship propulsion machine.

2. Description of Background Art

In background art, an apparatus of changing the angle of a ship propulsion machine body with respect to a hull by extending and retracting a cylinder apparatus connected between the hull and the ship propulsion machine body is proposed.

For example, a tilt-trim apparatus described in JP-UM-B-7-32385 (Patent Document 1) is configured as follows. That is, a hydraulic cylinder is installed between a bracket attaching a propulsion unit (ship propulsion machine body) to the ship and the propulsion unit, current-carrying actuation circuits on an "up" side and a "down" side of an electric drive motor are on/off operated to drive a hydraulic pump, and working fluid fed by pressure by the hydraulic pump is supplied to a piston-side oil chamber or a piston-rod side oil chamber of the hydraulic cylinder, thereby extending and retracting the hydraulic cylinder, as a result, the propulsion unit is tilt-trim operated to the "up" side or the "down" side. Then, an operation switch for on/off operating the current-carrying actuation circuits on the "up" side and the "down" side of the drive motor is included, in which an on-state is maintained only while the operation switch is pressed by adding manual operation force to the operation switch and the circuit is turned off when the switch is released.

SUMMARY OF THE INVENTION

In the structure of adjusting the tilt angle of the ship propulsion machine body with respect to the hull by keeping pressing the operation switch, it is difficult to adjust the tilt angle to a desired angle. It is particularly difficult for a beginner of ship operation to adjust the angle to a desired angle for keeping a travelling posture at the time of high-speed travelling. Accordingly, for example, when an operator keeps pressing a button for increasing the tilt angle to adjust the angle to a desired tilt angle, the angle exceeds the desired tilt angle, then, it is necessary to press a button for decreasing the tilt angle again to adjust the angle to the desired tilt angle. As a result, the electric motor has to be driven uselessly or it is difficult to adjust the tilt angle quickly.

An object of the present invention is to provide an apparatus capable of adjusting the tilt angle of the ship propulsion machine body with respect to the hull to a tilt angle suitable for a travelling state easily and with high accuracy.

In order to achieve the above object, the present invention provides a tilt-angle adjusting apparatus including a motor adjusting a tilt angle of a ship propulsion machine body with respect to a hull and a motor control unit configured to control drive of the motor so as to change the tilt angle in accordance with an output from a detecting unit configured to detect a hull angle as an angle of the hull with respect to the water surface.

Here, the motor control unit may recognize the hull angle based on a signal from the detecting unit provided at the hull and detecting the hull angle and may control drive of the motor so that the recognized hull angle becomes a given angle.

Moreover, the motor control unit may rotate the motor to one rotation direction when the hull angle is larger than the given angle and may rotate the motor to the other rotation direction when the hull angle is smaller than the given angle.

Furthermore, the tilt-angle adjusting apparatus may further include an operating unit to be operated for adjusting the tilt angle, and the motor control unit may control drive of the motor based on a signal outputted from the operating unit in the case where the operating unit is operated even when the hull angle is different from the given angle.

According to another aspect of the invention, there is provided a ship propulsion machine giving propulsion to a hull including a ship propulsion machine body including a propeller, and a tilt-angle adjusting apparatus having a motor adjusting a tilt angle of the ship propulsion machine body with respect to the hull, and a motor control unit configured to control drive of the motor so as to change the tilt angle in accordance with a hull angle as an angle of the hull with respect to the water surface.

According to an embodiment of the invention, it is possible to adjust the tilt angle of the ship propulsion machine body with respect to the hull to a tilt angle suitable for a travelling state easily and with high accuracy.

DESCRIPTION OF EMBODIMENT

Hereinafter, an embodiment of the present invention will be explained in detail with reference to the attached drawings.

Figure 1A:
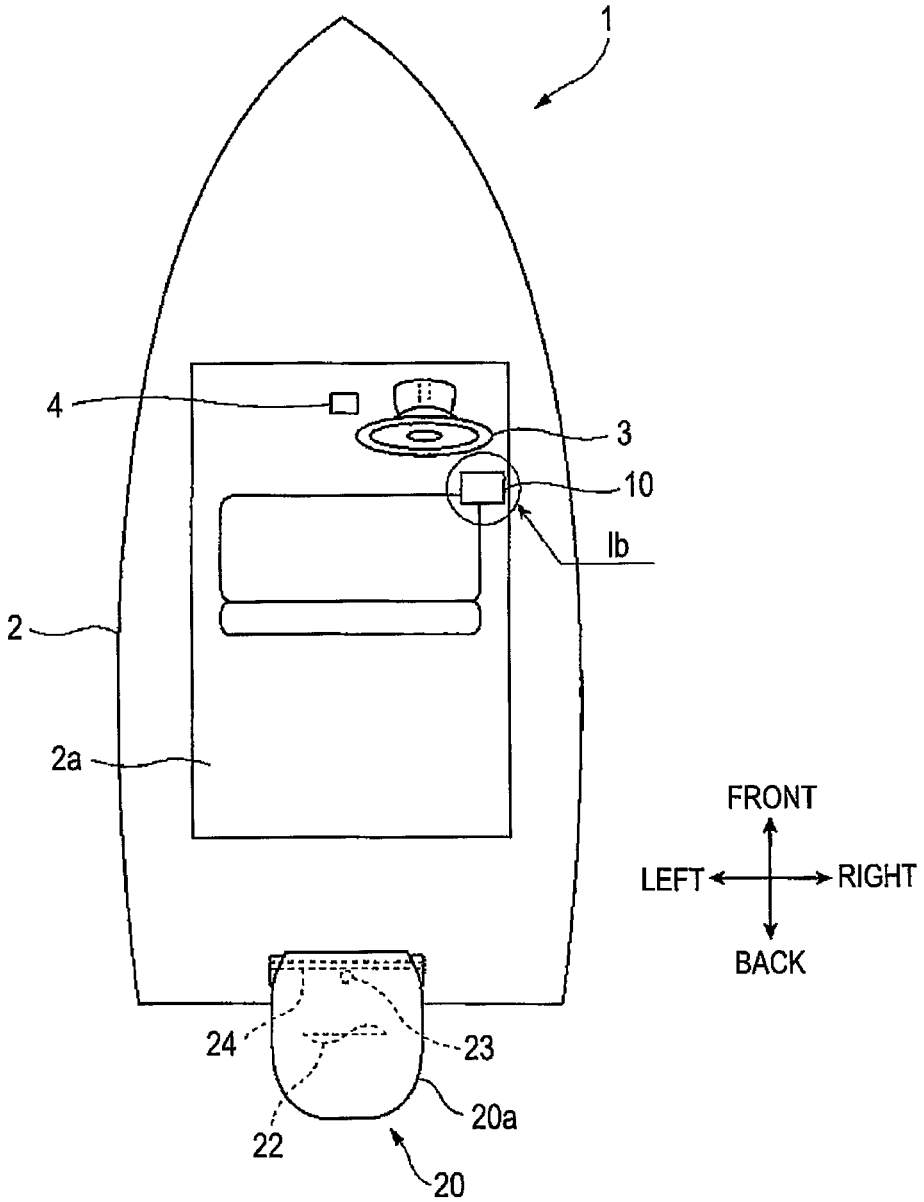
FIGS. 1A and 1B are schematic structure views of a ship according to an embodiment.
Figure 1B:
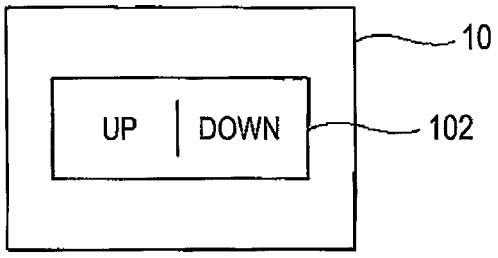

FIGS. 1A and 1B are schematic structure views of a ship 1 according to the embodiment. FIG. 1A is a view of the ship 1 seen from the above. FIG. 1B is an enlarged view of a part "Ib" of FIG. 1A. In the following explanation, a travelling direction of the ship 1 in a forward movement state is defined as a front direction, the left side of the travelling direction is defined as a left direction and the right side of the travelling direction is defined as a right direction.

The ship 1 includes a hull 2, an annular steering wheel 3 rotatably attached to an instrument panel formed in a front part of a cabin 2*a* provided in the hull 2, a remote-controller box 10 provided in a front-right part of the cabin 2*a* and a ship propulsion machine 20 generating propulsion.

The ship 1 also includes a hull angle sensor 4 arranged in the vicinity of the steering wheel 3 in the cabin 2*a*, outputting a signal corresponding to a hull angle θs as a tilt angle in a front and back direction of the hull 2 with respect to a horizontal surface. The hull angle sensor 4 has a pendulum (not shown) to which a magnet is attached, detecting a displacement from a vertical axis thereof by a reed switch (not shown) or the like and outputting a signal corresponding to the hull angle θs. As the hull angle sensor 4, a sensor outputting a Lo signal when the hull angle θs is at a later described given angle θ0 or less and outputting a Hi signal when the hull angle θs is higher than the given angle θ0 can be cited as an example.

The remote-controller box 10 is provided with a tilt-angle adjustment switch 102 as an example of an operating unit configured to adjust a tilt angle θ (see FIG. 2) of a ship propulsion machine body 20*a* of the ship propulsion machine 20 for the hull 2, which will be described later.

Next, the ship propulsion machine 20 will be explained.

Figure 2:
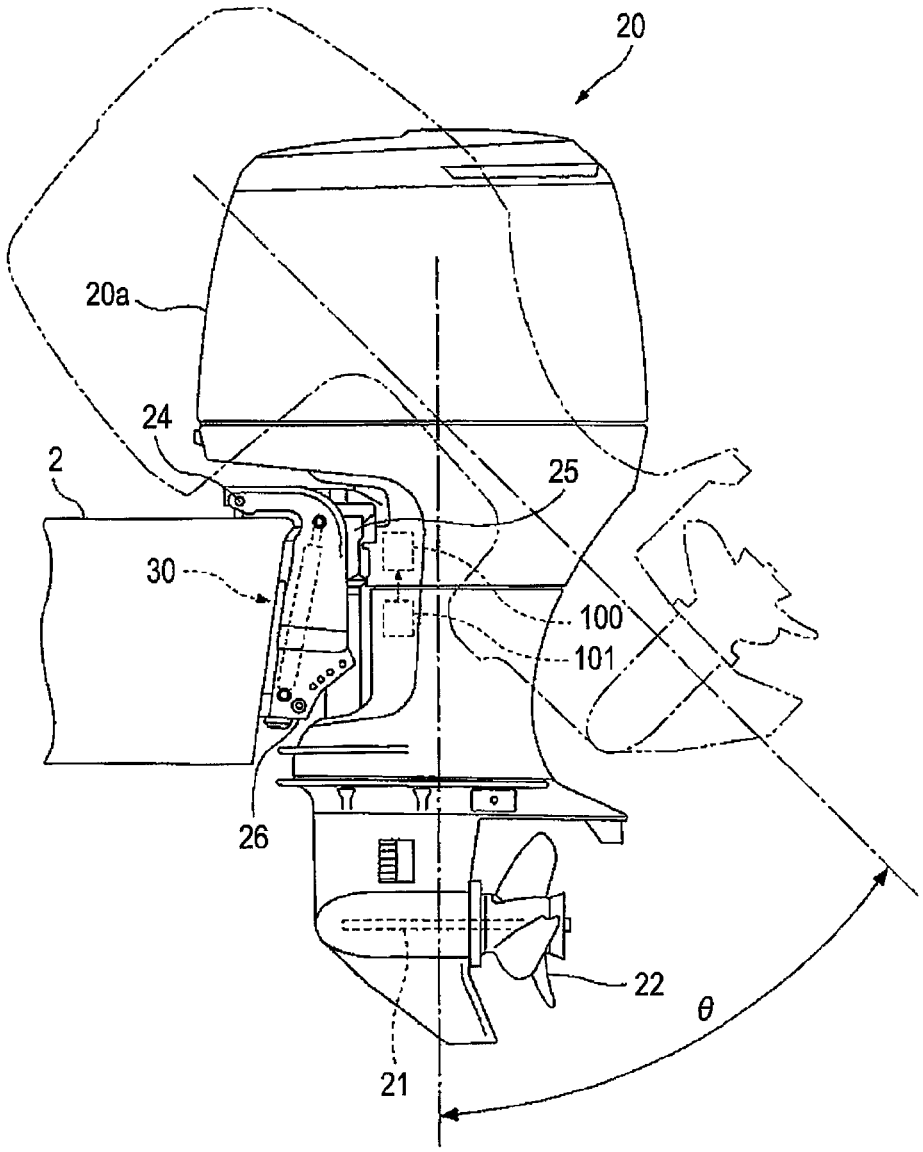
FIG. 2 is a schematic structure view of a ship propulsion machine.

FIG. 2 is a schematic structure view of the ship propulsion machine 20.

The ship propulsion machine 20 includes the ship propulsion machine body 20*a* generating propulsion and a tilt-angle adjusting apparatus 30 adjusting the tilt angle θ.

The ship propulsion machine body 20*a* has an engine (not shown) placed so that an axial direction of a crankshaft (not shown) is directed to a vertical direction (up and down direction) with respect to the water surface, a drive shaft (not shown) connected to a lower end of the crankshaft so as to be rotatable together and vertically extending downward, a propeller shaft 21 connected to the drive shaft through a bevel gear mechanism and a propeller 22 fixed to a back end of the propeller shaft 21.

The ship propulsion machine body 20*a* has also a swivel shaft 23 (see FIG. 1) provided in the vertical direction (up and down direction), a horizontal shaft 24 provided in a horizontal direction with respect to the water surface, a swivel case 25 in which the swivel shaft 23 is housed so as to swivel freely and a stern bracket 26 connecting the swivel case 25 to the hull 2.

Next, the tilt-angle adjusting apparatus 30 will be explained.

The tilt-angle adjusting apparatus 30 includes a control device 100 controlling actuation of the tilt-angle adjusting apparatus 30, a tilt angle sensor 101 detecting the tilt angle θ and a tilt-angle adjustment switch 102 (see FIG. 1) for adjusting the tilt angle θ.

As the tilt angle sensor 101, for example, an optical sensor detecting a distance between a back end portion of the hull 2 and the ship propulsion machine body 20*a* can be cited as an example. The tilt angle sensor 101 may have any structure which can detect a swivel angle of the swivel case 25 with respect to the stern bracket 26.

The tilt-angle adjustment switch 102 is a seesaw switch which can be pressed at a left portion and a right portion. The tile angle θ is increased when the left portion (UP side) is pressed and the tile angle θ is decreased when the right portion (DOWN side) is pressed.

Figure 3:
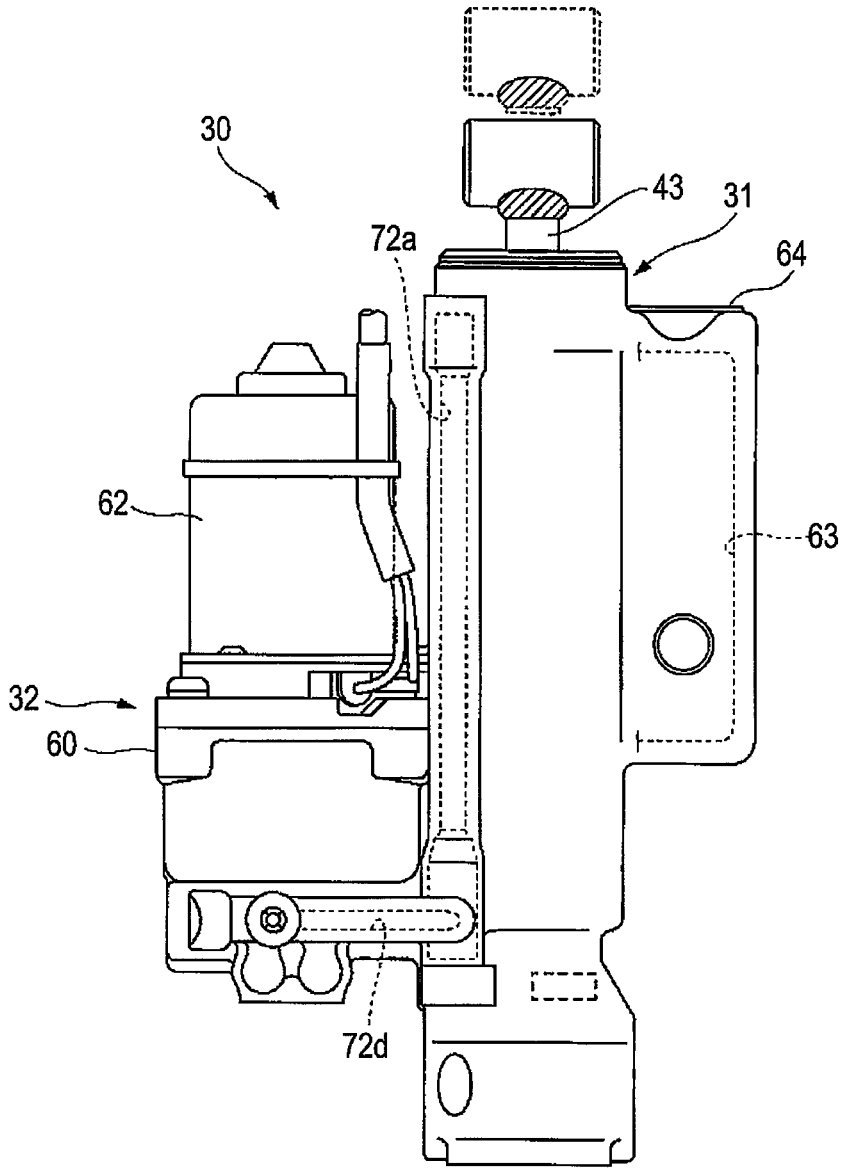
FIG. 3 is an outline view of a tilt-angle adjusting apparatus.
Figure 4:
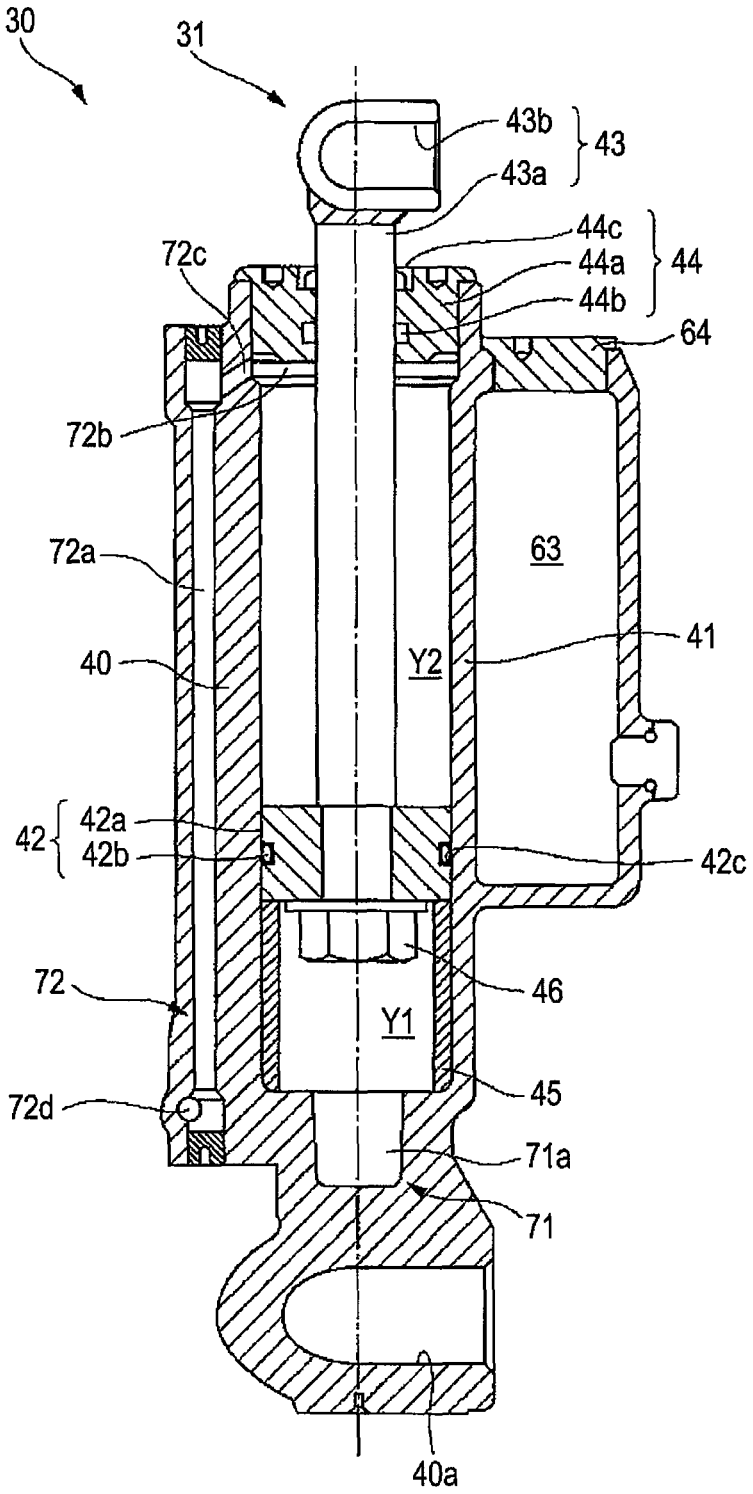
FIG. 4 is a cross-sectional view of a cylinder apparatus and a pump chamber.
Figure 5:
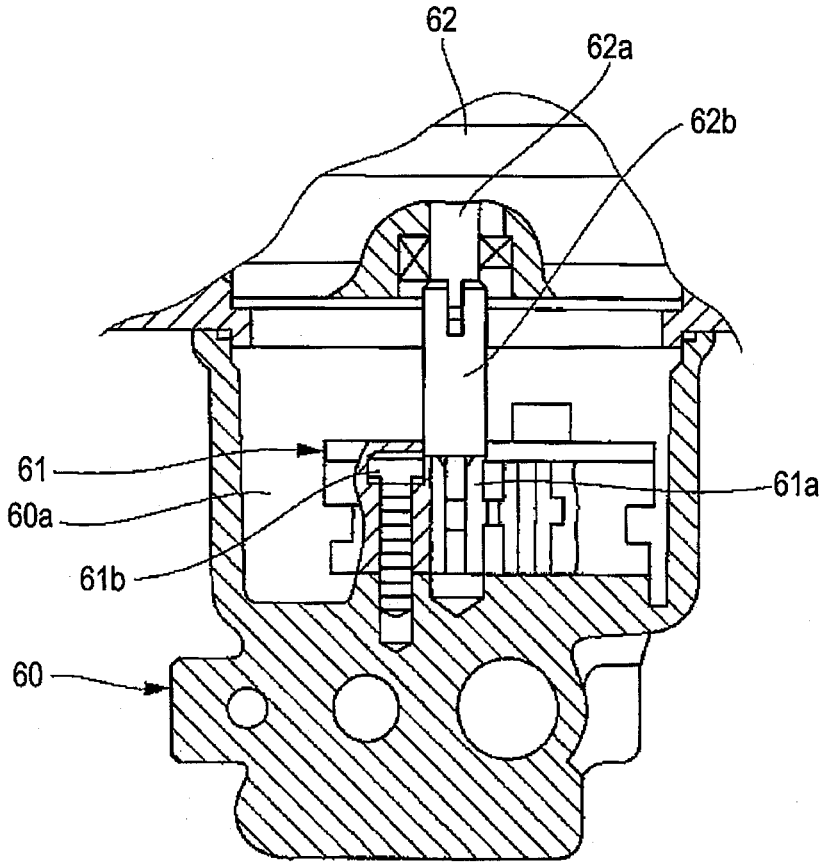
FIG. 5 is a cross-sectional view of a motor support portion.

FIG. 3 is an outline view of the tilt-angle adjusting apparatus 30. FIG. 4 is a cross-sectional view of a later-described cylinder apparatus and a pump chamber. FIG. 5 is a cross-sectional view of a later-described motor support portion.

The tilt-angle adjusting apparatus 30 has a cylinder apparatus 31 connected between the swivel case 25 and the bracket 26 extending and retracting for changing a distance therebetween and a fluid supply/drain apparatus 32 circulating working fluid for extending and retracting the cylinder apparatus 31.

First, the cylinder apparatus 31 will be explained.

The cylinder apparatus 31 has a cylindrical portion and includes a housing 40 having a cylinder 41 with a bottomed cylindrical shape in which one end of the cylindrical portion in a center-line direction (up and down direction in FIG. 4) is closed.

The center-line direction of the cylindrical portion of the cylinder 41 is referred to merely as the "center-line direction" in the following description.

The cylinder apparatus 31 has also a piston 42 inserted into the cylinder 41 so as to move in the center-line direction and a piston rod 43 extending in the center-line direction and to which the piston 42 is attached at one end (a lower end portion in FIG. 4) in the center-line direction. The cylinder apparatus 31 further includes a nut 46 supporting the piston 42 with a male screw formed at one end of the piston rod 43, a rod guide 44 arranged so as to close an opening on the other end side of the cylinder 41 and guiding the piston rod 43 and a cylindrical sleeve 45 for adjusting the stroke of the piston rod 43.

The housing 40 includes the cylinder 41, a later-described motor support portion 60 and a tank chamber 63 integrally. Moreover, flow paths as paths through which the working fluid flows are formed around the cylinder 41, the motor support portion 60 and the tank chamber 63 as described later. At one end of the housing 40 in the center-line direction, a pin hole 40*a* supporting a pin for connecting the tilt-angle adjusting apparatus 30 to the stern bracket 26 is formed.

The piston 42 has a cylindrical piston body 42*a* in which a hole into which the piston rod 43 is inserted is formed at the center and a sealing member 42*b* such as an O-ring attached to an outer peripheral portion of the piston body 42*a*. On the outer peripheral portion of the piston body 42*a*, a groove 42*c* concave from an outer peripheral surface is formed over the entire circumference, and the sealing member 42*b* is fitted to the groove 42*c*. Then, the piston 42 touches an inner peripheral surface of the cylinder 41, sectioning the space in the cylinder 41 in which the working fluid is sealed into a first oil chamber Y1 on one end side in the center-line direction with respect to the piston 42 and a second oil chamber Y2 on the other end side in the center-line direction with respect to the piston 42.

The piston rod 43 has a cylindrical rod portion 43*a*, in which a male screw for attaching the piston 42 is formed at one end in the center-line direction and a pin hole 43*b* supporting a pin for connecting the piston rod 43 to the swivel case 25 is formed at the other end in the center-line direction.

The rod guide 44 includes an approximately cylindrical rod guide body 44*a* in which a hole into which the piston rod 43 is inserted is formed at the center, a sealing member 44*b* which is in sliding contact with the piston rod 43 at the center in the center-line direction and a water sealing 44*c* suppressing liquid such as water entering into the cylinder 41 at the other end in the center-line direction. A groove concave from an inner peripheral surface is formed in the inner periphery of the rod guide body 44*a*, and the sealing member 44*b* is fitted to the groove. Moreover, a concave portion concave from an end surface is formed at the other end of the rod guide body 44*a* in the center-line direction, and the water sealing 44*c* is fitted to the concave portion.

The sleeve 45 has a cylindrical shape, and an inner peripheral diameter thereof is smaller than an outer diameter of the piston body 42*a* of the piston 42. Then, the sleeve 45 is arranged close to one end side of the cylinder 41 in the center-line direction, which restricts the movement of the piston 42 and the piston rod 43 toward one end side.

Next, the fluid supply/drain apparatus 32 will be explained.

The fluid supply/drain apparatus 32 includes a pump 61 supplying working fluid into the cylinder 41 of the cylinder apparatus 31, a motor 62 driving the pump 61 and a motor support portion 60 supporting the motor 62. The fluid supply/drain apparatus 32 has also a tank chamber 63 storing the working fluid to be supplied and drained with respect to the pump 61 and an oil supply plug 64 closing an opening of the tank chamber 63.

The motor support portion 60 is provided in the above housing 40 so as to be adjacent to the cylinder 41 in a direction intersecting with the center-line direction. That is, the housing 40 has the cylinder 41 and the motor support 60 integrally. Then, the motor 62 is fixed to the other end side (an upper side in FIG. 4) of the motor support portion 60 in the center-line direction by using a bolt. Also in the motor support portion 60, a portion (a lower side in FIG. 4) closer to one end side than the portion to which the motor 62 is fixed in the center-line direction is concave, and the concave portion forms a pump chamber 60*a* for housing the pump 61. The pump chamber 60*a* houses working fluid as well as keeps the pump 61 in a state of being immersed in the working fluid.

The pump 61 is, for example, a gear pump having a cassette pump structure, having a gear unit including a drive gear and a driven gear in a case, which is fixed to the motor support portion 60 by a bolt 61*b* inside the pump chamber 60*a* so that a drive shaft 61*a* coupled to the drive gear is positioned to an output shaft 62*a* of the motor 62. The pump 61 can be also rotated in both directions, connecting two discharge ports (not shown) for normal rotation and reverse rotation to the flow paths formed in the motor support portion 60 and opening two suction ports (not shown) for normal rotation and reverse rotation in the pump chamber 60*a*.

In the motor 62, a yoke made of steel is attached to the motor support portion 60 by the bolt so that the motor 62 is positioned above the pump chamber 60*a*. The output shaft 62*a* of the motor 62 is connected to the drive shaft 61*a* of the pump 61 through a drive joint 62*b*, rotating in both directions.

The tank chamber 63 is provided so as to be adjacent to the cylinder 41 in the direction intersecting with the center-line direction. The motor support portion 60 communicates the tank chamber 63 to the pump chamber 60*a*.

Next, the flow paths for working fluid formed in the tilt-angle adjusting apparatus 30 will be explained.

In the tilt-angle adjusting apparatus 30, a first flow path 71 communicating the first oil chamber Y1 to the pump chamber 60*a* and a second flow path 72 communicating the second oil chamber Y2 to the pump chamber 60*a* are formed.

The first flow path 71 includes an oil path 71*a* formed in the housing 40 closer to one end side (the lower side in FIG. 4) rather than one end of the cylinder 41 in the center-line direction (the lower end portion in FIG. 4), an oil path (not shown) formed in the motor support portion 60 closer to one end side (the lower side in FIG. 4) in the center-line direction than the pump chamber 60*a* and so on.

The second flow path 72 includes, as shown in FIG. 4, an oil path 72*a* formed in the housing 40 in the center-line direction so as to be adjacent to the cylinder 41, an oil path 72*b* formed at the rod guide 44, an oil path 72*c* formed in the cylinder 41 so as to communicate the oil path 72*a* to the oil path 72*b*, an oil path 72*d* formed in the motor support portion 60 closer to one end side (the lower side of FIG. 4) in the center-line direction than the pump chamber 60*a* and so on.

Figure 6:
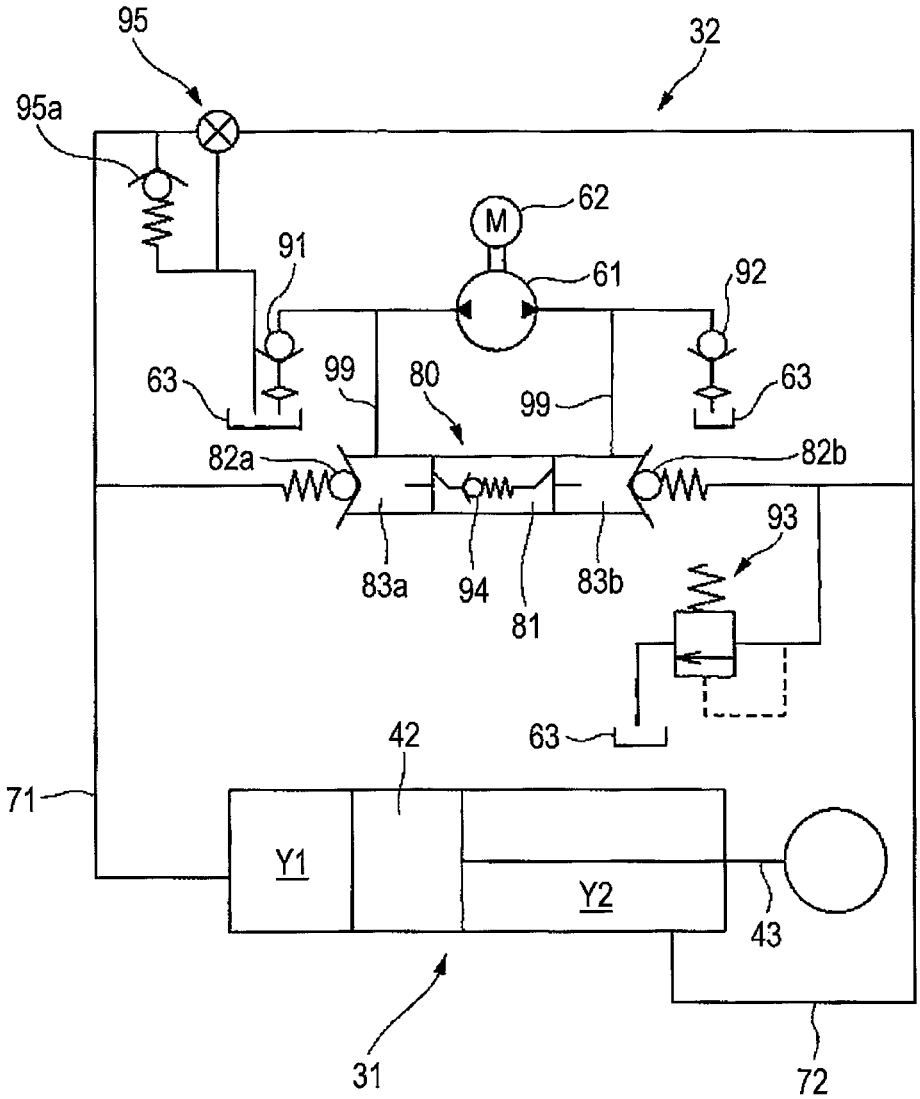
FIG. 6 is a schematic diagram showing the arrangement of flow paths of working fluid to be supplied and drained by a fluid supply/drain apparatus and valves provided on the flow paths.

FIG. 6 is a schematic diagram showing the arrangement of the flow paths of the working fluid to be supplied and drained by the fluid supply/drain apparatus 32 and valves provided on the flow paths.

The fluid supply/drain apparatus 32 includes a shuttle-type changeover valve 80, non-return valves 91, 92, a retraction-side relief valve 93, an extension-side relief valve 94 and a manual and thermal valve 95.

The shuttle-type changeover valve 80 has a shuttle piston 81 and a first check valve 82*a* and a second check valve 82*b* arranged at both sides of the shuttle piston 81. In the shuttle-type changeover valve 80, a first shuttle chamber 83*a* is formed on the first check valve 82*a* side of the shuttle piston 81 and a second shuttle chamber 83*b* is formed on the second check valve 82*b* side of the shuttle piston 81.

The first check valve 82*a* can be opened by oil feed pressure added to the first shuttle chamber 83*a* through a pipe line 99 by normal rotation of the pump 61, and the second check valve 82*b* can be opened by oil feed pressure added to the second shuttle chamber 83*b* through the pipe line 99 by reverse rotation of the pump 61. Additionally, the shuttle piston 81 can open the second check valve 82*b* by oil feed pressure by normal rotation of the pump 61 and can open the first check valve 82*a* by oil feed pressure by reverse rotation of the pump 61. The first check valve 82*a* of the shuttle-type changeover valve 80 is connected to the first flow path 71 and the second check valve 82*b* is connected to the second flow path 72.

The non-return valves 91 and 92 are each arranged at an intermediate part of a connection flow path between the pump 61 and the tank chamber 63. The retraction-side relief valve is connected to the second flow path 72, and the extension-side relief valve 94 is housed inside the shuttle piston 81. The manual and thermal valve 95 is connected to the oil path 71*a* (see FIG. 4) of the first flow path 71, connecting the first oil chamber Y1 to the tank chamber 63. The manual and thermal valve 95 includes a thermal relief valve 95*a*, relieving circuit pressure to the tank chamber 63 with a predetermined pressure when pressure of working fluid in the cylinder 41 is abnormally increased due to heat and so on.

Next, working of the tilt-angle adjusting apparatus 30 will be explained.

When the motor 62 is normally rotated to thereby normally rotate the pump 61, discharged oil from the pump 61 opens the first check valve 82*a* of the shuttle-type changeover valve 80 as well as opens also the second check valve 82*b* through the shuttle piston 81. Accordingly, the discharged oil from the pump 61 is supplied to the first oil chamber Y1 of the cylinder apparatus 31 through the first check valve 82*a* and the first flow path 71, and working fluid of the second oil chamber Y2 of the cylinder apparatus 31 is returned to the pump 61 through the second flow path 72 and the second check valve 82*b* to thereby extend the cylinder apparatus 31. As a result, the tilt angle θ (see FIG. 2) is increased.

At the time of operation for increasing the tilt angle θ, the amount of circulating oil of working fluid will be short in supply as the volume of the cylinder 41 is increased by the withdrawal volume of the piston rod 43, therefore, the non-return valve 92 opens and the shortfall of the circulating oil can be compensated to the pump 61 from the tank chamber 63. Additionally, at the time of operation for increasing the tilt angle θ, in the case where the circuit pressure becomes higher than a predetermined pressure as the pump 61 keeps working after the piston 42 reaches the maximum extended position and the operation for increasing the tilt angle θ is completed, the extension-side relief valve 94 opens to thereby relieve the circuit pressure to the pump suction side.

On the other hand, when the motor is reversely rotated to thereby reversely rotate the pump 61, discharged oil from the pump 61 opens the second check valve 82*b* of the shuttle-type changeover valve 80 as well as opens also the first check valve 82*a* through the shuttle piston 81. Accordingly, the discharged oil from the pump 61 is supplied to the second oil chamber Y2 of the cylinder apparatus 31 through the second check valve 82*b* and the second flow path 72, and working fluid of the first oil chamber Y1 of the cylinder apparatus 31 is returned to the pump 61 through the first flow path 71 and the first check valve 82*a* to thereby retract the cylinder apparatus 31. As a result, the tilt angle θ (see FIG. 2) is decreased.

At the time of operation for decreasing the tilt angle θ, the amount of circulating oil of working fluid will be excessive as the volume of the cylinder 41 is reduced by the approach volume of the piston rod 43, therefore, the retraction-side relief valve 93 opens and the excessive amount of the circulating oil is returned to the tank chamber 63. Additionally, when the pump 61 keeps working after the piston 42 reaches the maximum retraction position and the operation for decreasing the tilt angle θ is completed and there becomes no oil to be returned to the pump 61 from the first oil chamber Y1, the non-return valve 91 opens and working fluid can be supplied from the tank chamber 63. Also in the case where the circuit pressure becomes higher than a predetermined pressure as the pump 61 keeps working after the operation for decreasing the tilt angle θ is completed, the retraction-side relief valve 93 opens to relieve the circuit pressure to the tank chamber 63.

When the cylinder apparatus 31 is retracted manually, the manual and thermal valve 95 opens, therefore, the tilt angle θ can be decreased.

Next, the control device 100 will be explained.

Figure 7:
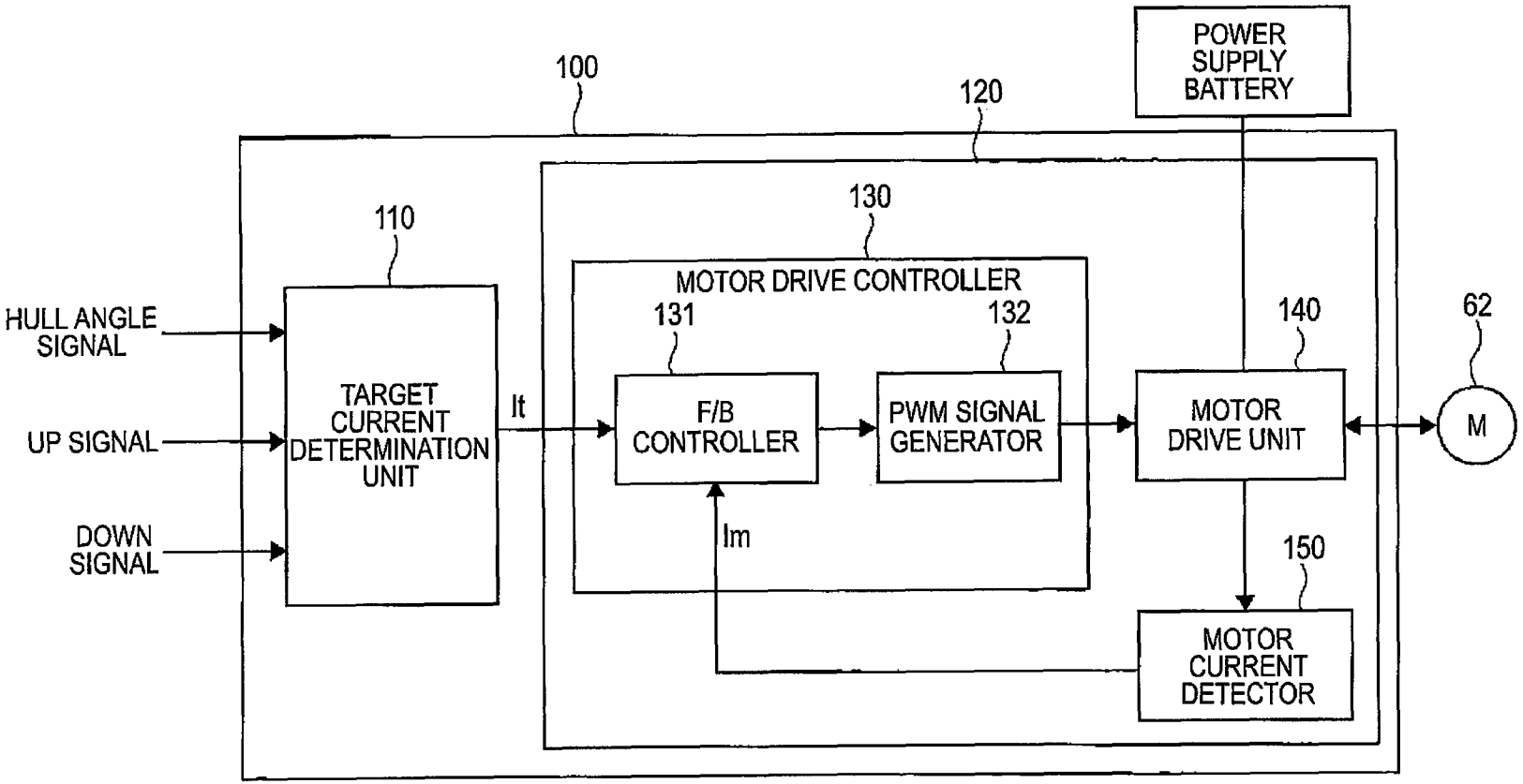
FIG. 7 is a schematic configuration diagram of a control device.

FIG. 7 is a schematic configuration diagram of the control device 100.

The control device 100 is an arithmetic logic circuit including a CPU, a ROM, a RAM, a backup RAM and so on. A hull angle signal obtained by converting the hull angle θs detected by the hull angle sensor 4 into an output signal, an "up" signal as a signal indicating that the left portion of the tilt-angle adjustment switch 102 has been pressed and a "down signal" as a signal indicating that the right portion of the tilt-angle adjustment switch 102 has been pressed are inputted to the control device 100.

Then, the control device 100 includes a target current determination unit 110 determining a target current It to be supplied to the motor 62 of the tilt-angle adjusting apparatus 30 based on the hull angle signal, the "up" signal and the "down" signal and a controller 120 performing feedback control and the like based on the target current It determined by the target current determination unit 110. As described above, the control device 100 functions as an example of a motor control unit configured to control the drive of the motor 62. The target current determination unit 110 will be described later.

First, the controller 120 will be explained.

The controller 120 includes a motor drive controller 130 controlling actuation of the motor 62 of the tilt-angle adjusting apparatus 30, a motor drive unit 140 driving the motor 62 and a motor current detector 150 detecting an actual current Im actually flowing in the motor 62.

The motor drive controller 130 includes a feedback (F/B) controller 131 performing feedback control based on a deviation between the target current It determined by the target current determination unit 110 and the actual current Im detected by the motor current detector 150 and supplied to the motor 62, and a PWM signal generator 132 generating a PWM (pulse width modulation) signal for performing PWM control to the motor 62.

The motor drive unit 140 includes a motor drive circuit in which four field-effect transistors for electric power are connected in a configuration of an H-type bridge circuit and a gate drive circuit unit in which gates of two field-effect transistors selected from the four field-effect transistors are driven to allow these field-effect transistors to perform switching operation. The gate drive circuit unit controls the drive of the motor 62 by selecting two field-effect transistors and allowing the selected two field-effect transistors to perform switching operation based on the PWM signal (drive control signal) outputted from the PWM signal generator 132.

The motor current detector 150 detects a value of the actual current Im flowing in the motor 62 from a voltage generated at both ends of a shunt resistance connected to the motor drive unit 140.

Next, the target current determination unit 110 will be explained.

Figure 8A:
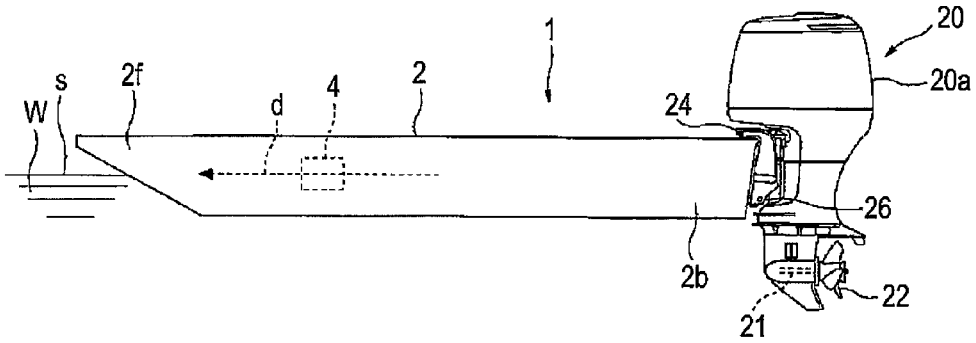
FIGS. 8A, 8B and 8C are views showing the relation between travelling states of the ship and hull angles.
Figure 8B:
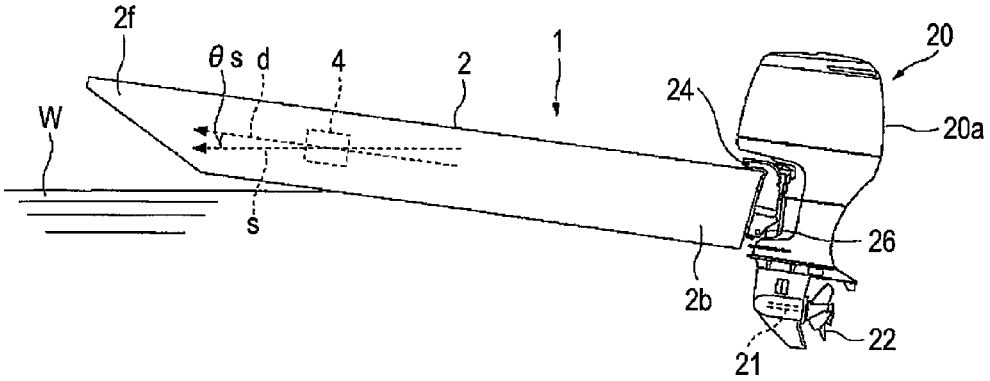
Figure 8C:
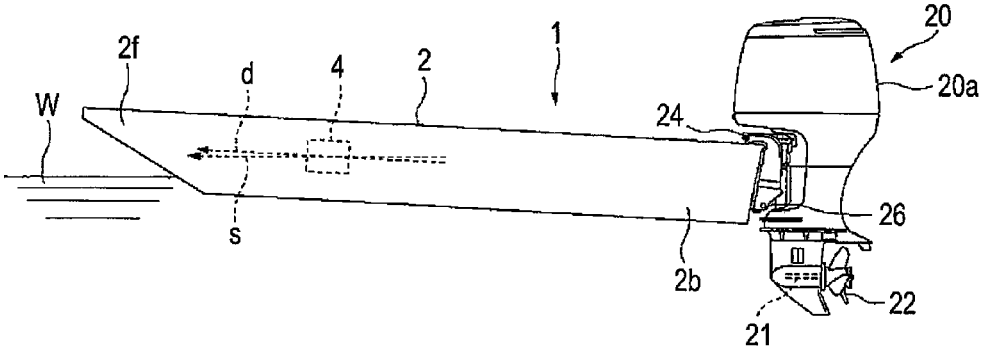

FIGS. 8A to 8C are views showing the relation between travelling states of the ship and hull angles. In FIGS. 8A to 8C, the front and back direction of the hull 2 is denoted by a sign "d", the water surface is denoted by a sign "s" and seawater or freshwater is denoted by a sign "w".

FIG. 8A shows a state in which the ship 1 is stopped or travels at a relatively low speed. When the speed of the hull 2 is increased from the above state as the propulsion of the ship, propulsion machine 20 is accelerated, the hull 2 becomes in a state in which a stem 2*f* is lifted, whereas a stern 2*b* sinks as shown in FIG. 8B. In this state, as the hull angle θs is higher than the later-described given angle θ0, the hull angle sensor 4 outputs a Hi signal.

After that, when the acceleration ends, the speed of the ship 1 becomes stable, the lifted stem 2*f* of the hull 2 comes down and the ship 1 becomes in a sliding state as shown in FIG. 8C. When the ship 1 becomes in the sliding state, the hull angle θs is reduced to the given angle θ0 or less, therefore, the hull angle sensor 4 outputs a Lo signal.

Note that the given angle θ0 is set to a value whereby it is possible to determine that acceleration ends and the ship 1 is in the sliding state and, for example, 5 deg can be cited as an example.

When the hull angle θs detected by the hull angle sensor 4 is larger than the given angle θ0, the target current determination unit 110 determines a predetermined given current It0 as the target current It for controlling the drive of the motor 62 to increase the tilt angle θ. On the other hand, when the hull angle θs detected by the hull angle sensor 4 is smaller than the given angle θ0, the target current determination unit 110 determines a value (=−It0) obtained by multiplying the given current It0 by "−1" as the target current It for controlling the drive of the motor 62 to reduce the tilt angle θ. The target current determination unit 110 also determines "0" as the target current It when the hull angle θs detected by the hull angle sensor 4 is equal to the given angle θ0. Concerning the sign of the target current It, the direction in which the motor 62 is normally rotated is defined as a plus, and the direction in which the motor 62 is reversely rotated is defined as a minus. The given current It0 is a positive value.

However, the target current determination unit 110 determines the given current It0 in the direction allowing the motor 62 to normally rotate as the target current It for increasing the tilt angle θ in the case where the "up" signal as the signal indicating that the left portion of the tilt-angle adjustment switch 102 has been pressed even when the hull angle θs detected by the hull angle sensor 4 is different from the given angle θ0. Moreover, the target current determination unit 110 determines "−It0" in the direction allowing the motor 62 to reversely rotate as the target current It for decreasing the tilt angle θ in the case where the "down" signal as the signal indicating that the right portion of the tilt-angle adjustment switch 102 has been pressed even when the hull angle θs detected by the hull angle sensor 4 is different from the given angle θ0.

Next, a procedure of target current determination processing performed by the target current determination unit 110 will be explained with reference to a flowchart.

Figure 9:
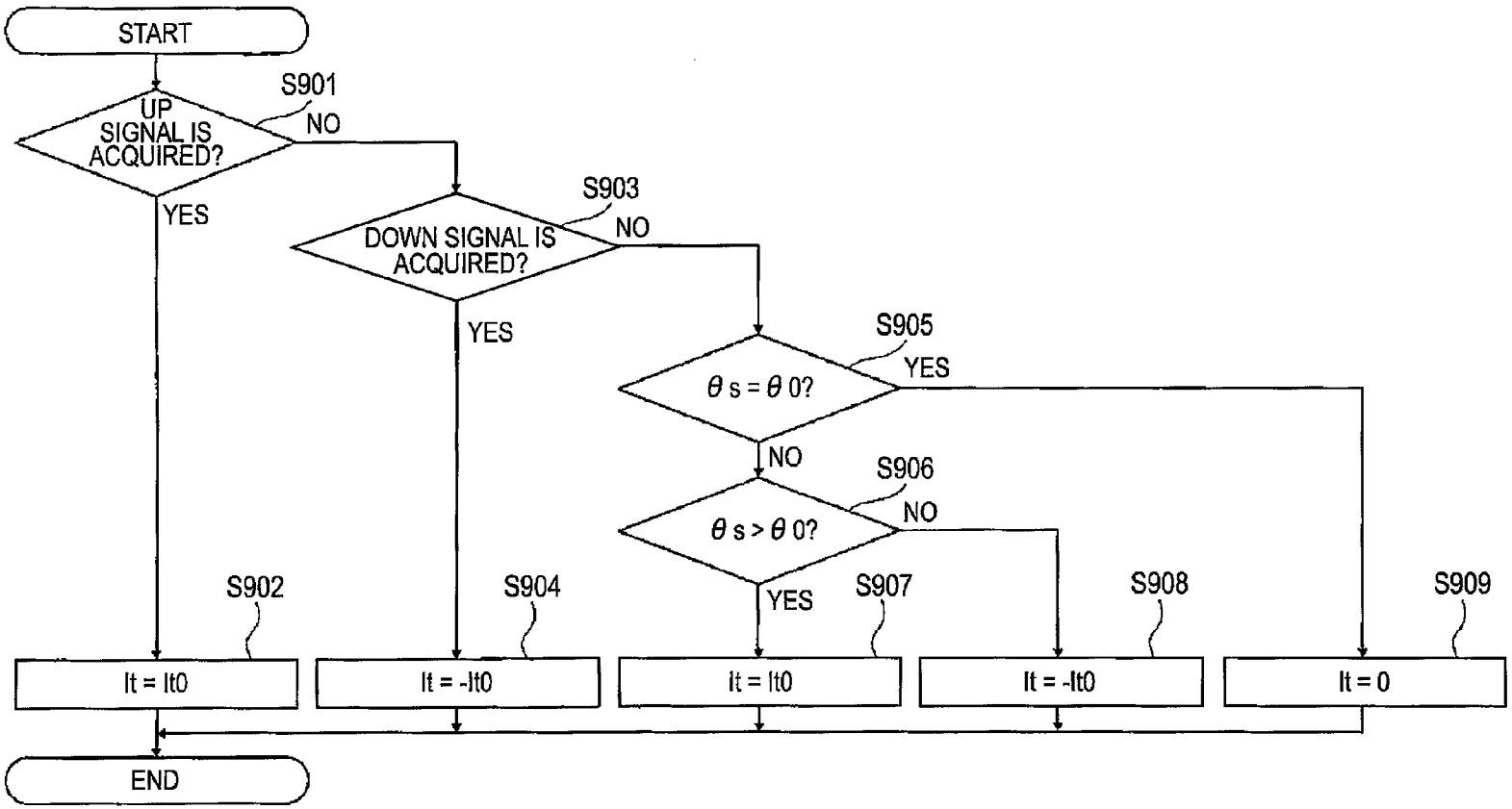
FIG. 9 is a flowchart showing a procedure of target current determination processing performed by a target current determination unit.

FIG. 9 is a flowchart showing the procedure of the target current determination processing performed by the target current determination unit 110. The target current determination unit 110 executes the target current determination processing repeatedly in every predetermined period.

First, the target current determination unit 110 determines whether the "up" signal is acquired or not (S901). Then, when the "up" signal is acquired (YES in S901), the target current It is determined to be the given current It0 in the direction allowing the motor 62 to normally rotate (S902). On the other hand, when the "up" signal is not acquired (NO in S901), the target current determination unit 110 determines whether the "down" signal is acquired or not (S903). Then, when the "down" signal is acquired (YES in S903), the target current It is determined to be "−It0" in the direction allowing the motor 62 to reversely rotate (S904).

On the other hand, when the "down" signal is not acquired (NO in S903), whether the hull angle θs detected by the hull angle sensor 4 is the given angle θ0 or not is determined (S905). When the hull angle θ is not the given angle θ0 (NO in S905), whether the hull angle θs is larger than the given angle θ0 or not is determined (S906). Then, when the hull angle θs is larger than the given angle θ0 (YES in S906), the target current It is determined to be the given current It0 in the direction allowing the motor 62 to normally rotate (S907). On the other hand, when the hull angle θs is not larger than the given angle θ0 (NO in S906), it is assumed that the hull angle θs is smaller than the given angle θ0, therefore, the target current It is determined to be "−It0" in the direction of allowing the motor 62 to reversely rotate (S908).

On one hand, when the hull angle θs is equal to the given angle θ0, the target current It is determined to be "0" (S909).

In the tilt-angle adjusting apparatus 30 configured as the above, when the hull angle θs detected by the hull angle sensor 4 is not equal to the given angle θ0 in the case where the tilt-angle adjustment switch 102 is not pressed, the target current It to be supplied to the motor 62 is determined so that the hull angle θs is equal to the given angle θ0. As a result, the hull angle θs is adjusted to the given angle θ0 at which a good travelling state can be obtained. As described above, the hull angle θs is automatically adjusted with high accuracy so that the hull angle θs becomes the given angle θ0 as a good angle for travelling in the tilt-angle adjusting apparatus 30 according to the present embodiment. Accordingly, even a beginner of ship operation can keep the travelling posture of the ship 1 in a good condition.

In the tilt-angle adjusting apparatus 30 according to the embodiment, the above advantages are realized by the simple configuration in which electric current to be supplied to the motor 62 is changed so that the hull angle θs detected by the hull angle sensor 4 provided in the ship 1 becomes the given angle θ0.

Though the target current It is changed according to whether the hull angle θs is equal to the given angle θ0, smaller than the given angle θ0, or larger than the given angle θ0 in the above embodiment, the present invention is not limited to these examples. For example, the target current It may be changed according to whether the hull angle θs is within a given range around the given angle θ0, smaller than the given range or larger than the given range. That is, in the case where the tilt-angle adjustment switch 102 is not pressed, when the hull angle θs is within the given range around the given angle θ0, the target current It may be determined to be "0", when the hull angle θs is larger than the given range, the target current It may be determined to be It0 and when the hull angle θs is smaller than the given range, the target current It may be determined to be −It0. As the given range around the given angle θ0, a range of θ0±0.5 degrees can be cited as an example.

Furthermore, an absolute amount is the same in the target current It determined due to the fact that the tilt-angle adjustment switch 102 is pressed and the target current It determined due to the fact that the hull angle θs is different from the given angle θ0 in the above embodiment, however, the present invention is not limited to the example. For example, the absolute value of the target current It determined due to the fact that the tilt-angle adjustment switch 102 is pressed is set to a current higher than the given current It0. Accordingly, the change speed of the tilt angle θ in the case where the tilt-angle adjustment switch 102 is pressed can be higher than the case where the tilt angle θ is changed due to that fact that the hull angle θs is different from the given angle θ0.

What is claimed is:

1. A tilt-angle adjusting apparatus comprising:

a motor adjusting a tilt angle of a ship propulsion machine body with respect to a longitudinal axis of a hull; and a motor control unit configured to control drive of the motor so as to change the tilt angle in accordance with an output from a detecting unit configured to detect a hull angle which is an angle of the hull with respect to a water surface, wherein the motor control unit recognizes the hull angle based on a signal from the detecting unit that is provided at the hull to detect the hull angle, and controls drive of the motor so that the recognized hull angle becomes a given angle, the motor control unit rotates the motor to one rotation direction so that the hull angle decreases when the hull angle is larger than the given angle, and rotates the motor to other rotation direction so that the hull angle increases when the hull angle is smaller than the given angle, and when the motor rotates in the one rotation direction, the tilt angle with respect to the longitudinal axis of the hull increases while the hull angle decreases, and when the motor rotates in the other rotational direction, the tilt angle with respect to the longitudinal axis of the hull decreases while the hull angle increases.

2. The tilt-angle adjusting apparatus according to claim 1, further comprising:

an operating unit that is configured to adjust the tilt angle, wherein the motor control unit controls drive of the motor based on a signal outputted from the operating unit in case where the operating unit is operated even when the hull angle is different from the given angle.

3. A ship propulsion machine giving propulsion to a hull comprising:

a ship propulsion machine body including a propeller; and a tilt-angle adjusting apparatus including a motor adjusting a tilt angle of the ship propulsion machine body with respect to a longitudinal axis of the hull, and a motor control unit configured to control drive of the motor so as to change the tilt angle in accordance with a hull angle which is an angle of the hull with respect to a water surface, wherein the motor control unit recognizes the hull angle based on a signal from the detecting unit that is provided at the hull to detect the hull angle, and controls drive of the motor so that the recognized hull angle becomes a given angle, the motor control unit rotates the motor to one rotation direction so that the hull angle decreases when the hull angle is larger than the given angle, and rotates the motor to other rotation direction so that the hull angle increases when the hull angle is smaller than the given angle, and when the motor rotates in the one rotation direction, the tilt angle with respect to the longitudinal axis of the hull increases while the hull angle decreases, and when the motor rotates in the other rotational direction, the tilt angle with respect to the longitudinal axis of the hull decreases while the hull angle increases.

* * * * *